US006434900B1

(12) United States Patent
Masters

(10) Patent No.: US 6,434,900 B1
(45) Date of Patent: Aug. 20, 2002

(54) PREFABRICATED CONCRETE WALL SYSTEM

(76) Inventor: Michael Masters, 1117 Seafarer La., Winter Springs, FL (US) 32708

( * ) Notice: Subject to any disclaimer, the term of this patent is extended or adjusted under 35 U.S.C. 154(b) by 0 days.

(21) Appl. No.: 09/766,421

(22) Filed: Jan. 22, 2001

Related U.S. Application Data

(60) Provisional application No. 60/212,795, filed on Jun. 14, 2000.

(51) Int. Cl.[7] ..... F04B 1/00

(52) U.S. Cl. ..... 52/283; 52/125.4; 52/125.6; 52/274; 52/295; 52/309.12; 52/309.17; 52/589.1; 256/73

(58) Field of Search ..... 52/125.3, 125.4, 52/125.6, 271, 274, 283, 284, 293.3, 295, 309.9, 309.12, 309.14, 309.17, 589.1, 590.1, 590.2; 256/19, 73; 405/286

(56) References Cited

U.S. PATENT DOCUMENTS

| | | | | | |
|---|---|---|---|---|---|
| 3,755,982 | A | * | 9/1973 | Schmidt | 52/295 |
| 4,038,798 | A | | 8/1977 | Sachs | |
| 4,249,354 | A | | 2/1981 | Wynn | |
| 4,532,745 | A | | 8/1985 | Kinard | |
| 4,616,459 | A | * | 10/1986 | Shubow | 52/309.12 |
| 4,924,641 | A | | 5/1990 | Gibbar | |
| 5,022,781 | A | * | 6/1991 | Smith | 404/6 |
| 5,279,089 | A | * | 1/1994 | Gulur | 52/309.11 |
| 5,335,472 | A | * | 8/1994 | Phillips | 52/309.12 X |
| 5,404,685 | A | * | 4/1995 | Collins | 52/309.7 |
| 5,488,806 | A | | 2/1996 | Melnick | |
| 5,566,521 | A | * | 10/1996 | Andrews et al. | 52/606 |
| 5,588,272 | A | * | 12/1996 | Haponski | 52/309.12 |
| 5,921,046 | A | | 7/1999 | Hammond | |
| 6,112,489 | A | * | 9/2000 | Zweig | 52/405.1 |
| 6,119,422 | A | * | 9/2000 | Clear et al. | 52/309.8 |
| 6,131,365 | A | * | 10/2000 | Crockett | 52/794.1 |
| 6,282,853 | B1 | * | 9/2001 | Blaney et al. | 52/223.7 |

* cited by examiner

*Primary Examiner*—Carl D. Friedman
*Assistant Examiner*—Brian E. Glessner
(74) *Attorney, Agent, or Firm*—Elsie C. Turner

(57) ABSTRACT

A prefabricated wall system for free-standing subdivision partitions, highway sound and visual barriers, privacy walls, or walls of a building having a plurality of prefabricated modular panels that are removably interconnected and installed. Each panel is essentially a factory-built sandwich having an expanded plastic foam core between two composite reinforcing wafers. Each wafer is comprised of an inner layer of fiberglass coated with an exterior layer of concrete reinforced with a grid of steel bars. The foam core has a pair of vertical cylindrical voids sized and spaced to mate with foundation columns pre-poured on site. The ends of each panel are reinforced with a steel sling lifting assembly embedded in concrete that includes removable eyebolts at the top edge whereby the panels can be attached to cables at each end for hoisting above the foundation columns and then lowering into place. A vertical groove or trough at each end of the panels receives a connector, such an expansion joint filler. Alternatively the panels can be formed with male tongues at one end and female grooves at the other for tongue-and-groove connection with adjacent panels. The foundation columns can support the panels above ground so that storm runoff waters pass freely thereunder.

8 Claims, 6 Drawing Sheets

PREFABRICATED CONCRETE WALL SYSTEM

This is a formal application based on an earlier-filed provisional application, Ser. No. 60/212,795, filed Jun. 19, 2000, of which Applicant claims the benefit.

BACKGROUND OF THE INVENTION

1. Field of the Invention

This invention relates to a prefabricated masonry wall system using foam core reinforced building panels and connectors. In particular, this invention is addressed to providing low-cost prefabricated, interconnecting, removable panels that can be used to form or refurbish subdivision walls or other free-standing walls, such as sound barriers parallel to roads and highways, retaining walls or privacy walls 2. Description of the Prior Art The use of rigid foam core building materials for construction of walls is well-known in the construction industry. For example, there are several manufacturers producing interlocking hollow rigid foam forms for reinforced poured concrete, used to create walls. The forms are assembled into the desired shape and are not removed after the concrete is poured, one reason therefor being that the foam is excellent acoustic as well as thermal insulation. This application is labor intensive and requires extensive on-site labor stacking the forms and pouring the concrete.

The use of prefabricated building materials incorporating rigid foam for constructing walls is also known in the art. U.S. Pat. No. 5,21,046 to Hammond teaches interconnection of prefabricated building panels made of a plastic foam core between wafers of plastic resin or acrylic and portland cement. The wafers are intended to provide lateral strength and an attractive finished surface. The wafers themselves, however, do not contain any reinforcing steel. The panels are typically 4 ft., high which would require stacking them to create a typical privacy or sound-barrier wall of 8 feet in height. Structural rigidity is provided by reinforced pours of concrete into vertical parallel voids spaced approximately 2 to 4 feet apart. The panels would obviously not be removable for reuse once the reinforcing pours are made, and would not be economical for refurbishing existing free-standing walls.

U.S. Pat. No. 4,038,798 to Sachs describes block form which requires stacking of many rows or layers which are permanent, and does not call for reinforcing steel.

U.S. Pat. No. 4,249,354 to Wynn teaches a reinforced, insulated wall construction of block, again requiring significant on-site stacking of layers and pours of concrete, rendering the wall non-removable.

U. S. Pat. No. 4,532,745 to Kinard discloses foam blocks with a thin coating of polyconcrete. These also require on-site stacking layer by layer and on-site pours of concrete.

U.S. Pat. No. 4,774,794 to Grieb describes interconnecting foam blocks, against stacked on site and then sheathed with fiberglass mat and coating with a thin layer of cement reinforced with cut fiberglass riving strands.

U.S. Pat. No. 4,924,642 to Gibbar describes another foam wall form for a concrete wall to be poured therein on-site.

U.S. Pat. No. 5,488,806 to Melnick teaches another foam block form to be assembled and to receive concrete on site in a permanent installation.

The Hammond patent refers to other inventions which describe related materials and methods, but they are dissimilar to the present invention.

Accordingly it is an object of this invention to provide a low-cost wall system of prefabricated interconnecting modular panels that do not require laborious manual stacking of layer upon layer of block.

Another object of this invention is to provide a wall system wherein the panels have channels to mate with pre-poured foundation columns, whereby the panels are removable and reusable.

A further object of this invention is to provide a modular wall system of panels which are factory made in a controlled environment.

Still another object of this invention is to provide modular wall panels with a foam core for acoustic and thermal insulation which have cementitious exterior surfaces reinforced with a steel grid.

Yet another object of this invention is to provide a system of modular panels that can be easily slipped over existing walls needing repair or refurbishing.

A further object of this invention is to provide a wall system wherein the panels are supported only at each end thereof on foundations, so that there is room between the ground and the bottom edge of each panel for unimpeded flow of runoff waters.

Yet another object of this invention is to provide a wall system adapted to use as a building wall as well as a subdivision partition or a highway sound barrier.

Other practical uses and adaptations of this invention should be apparent to those skilled in the art.

SUMMARY OF THE INVENTION

A prefabricated wall system for free-standing subdivision partitions, highway sound and visual barriers, privacy walls, or walls of a building comprises a plurality of prefabricated modular panels that are removably interconnected and installed. Each panel is essentially a factory-built sandwich having a foam plastic core between two composite reinforcing wafers. Each wafer is comprised of a layer of fiberglass coated with an exterior layer of concrete reinforced with a grid of steel bars. The foam core has a pair of vertical cylindrical voids sized and spaced to mate with foundation columns pre-poured on site. The ends of each panel are reinforced with a steel sling lifting assembly embedded in concrete that includes removable eyebolts at the top edge whereby the panels can be attached to cables at each end for hoisting above the foundation columns and then lowering into place. A vertical groove or trough at each end of the panels receives a removable connector, such as an expansion joint filler. Alternatively the panels can be formed with male tongues at one end and female grooves at the other for tongue-and-groove connection with adjacent panels. The foundation columns can support the panels above ground so that storm runoff waters pass freely thereunder.

DETAILED DESCRIPTION OF THE PREFERRED EMBODIMENT

Figure 1:
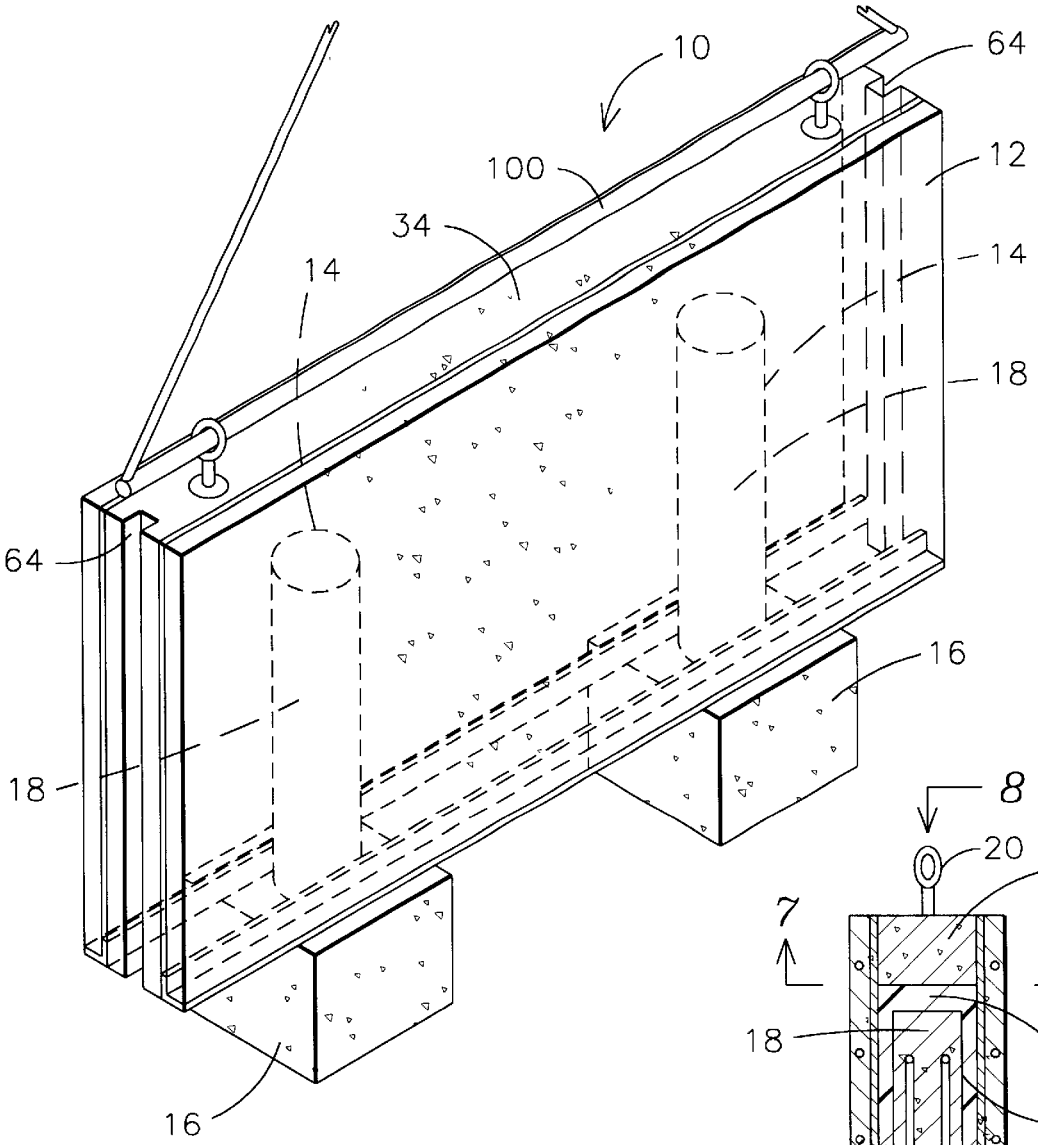
FIG. 1 is a perspective view of one section of a first embodiment of a prefabricated concrete wall system, configured to serve as a free-standing wall.

As shown in FIGS. land 2, the Prefabricated Concrete Wall System 10 has two main components. These are: (a) removable, multilayered, precast wall units 12 having bores 14; and (b) footing members 16 with integral column members 18 which mate with bores 14, the footing members 16 thereby supporting and securing wall units 12 in proper alignment. Footing members 16 are poured on site, in straight lines corresponding to the desired perimeter of the wall to be provided. Wall units 12 can be manufactured off-site, hoisted and lowered into place using a lifting rod or cable 100 inserted through removable eyebolts 20 attached to wall units 12.

Figure 2:
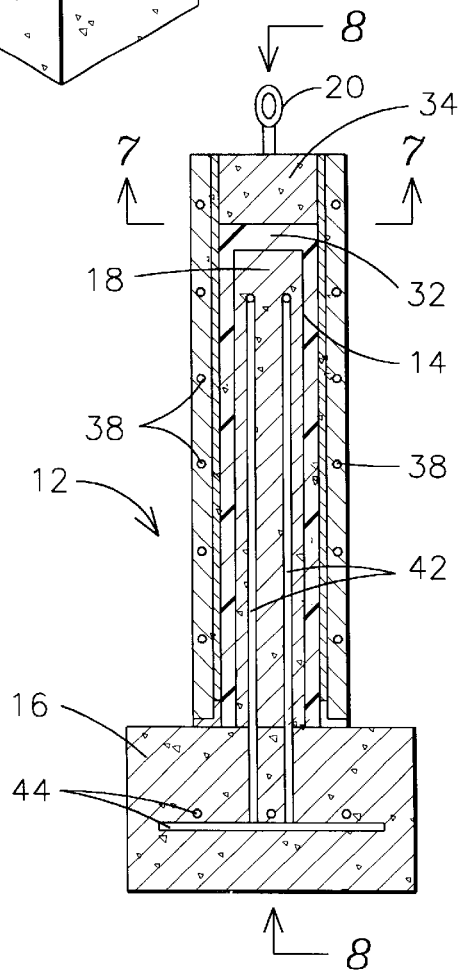
FIG. 2 is a vertical sectional view of the invention taken at 2—2 of FIG. 8.
Figure 3:
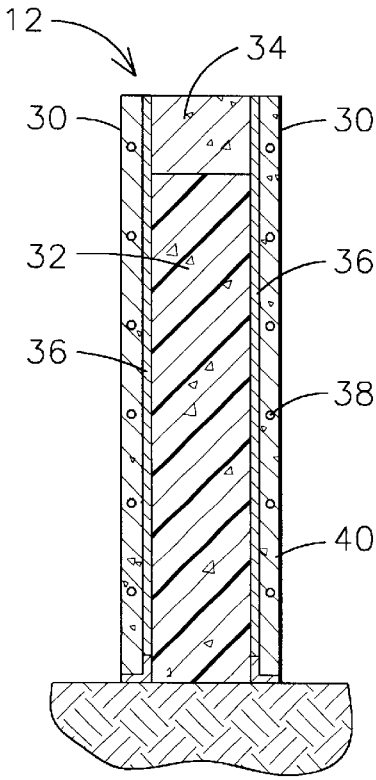
FIG. 3 is a vertical sectional view of the invention taken at 3—3 of FIG. 8.

As shown in FIGS. 2 and 3, wall units 12 are comprised of a pair of multilayered panels 30 forming a sandwich with a Styrofoam® block 32 as the core or filling, which also serves as a form for a final pour of concrete 34. Each panel 30 is constructed of an inner lining 36 of fiberglass, a grid 38 of vertical and horizontal reinforcing steel bar, and an outer layer 40 of poured concrete embedding grid 38 and bonding to inner lining 36. Decorative aggregate or other cosmetic surfacing can be added over the concrete if desired.

Footing member 16 and column members 18 are poured on site as integral units using conventional forms together with Sonitubes® for the columns 18. They are reinforced with two or more vertical steel bars 42 in the columns 18 and a grid 44 of horizontal steel bars in the footing members 16. These structures can be placed in the ground so that the top surface of the footing members 16 is above grade. This configuration results in empty spaces between the bottom of units 12 and the ground, thereby precluding accumulation of storm water on either side of the wall system.

Figure 5:
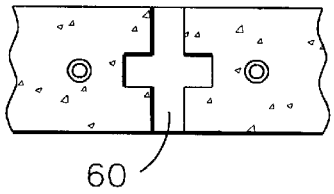
FIG. 5 is a top detail view of a junction of two wall units with a t-shaped connector.
Figure 6:
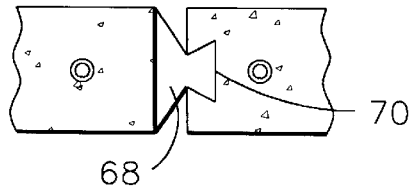
FIG. 6 is a top detail view of a junction of two wall units with a dovetail joint.
Figure 4:
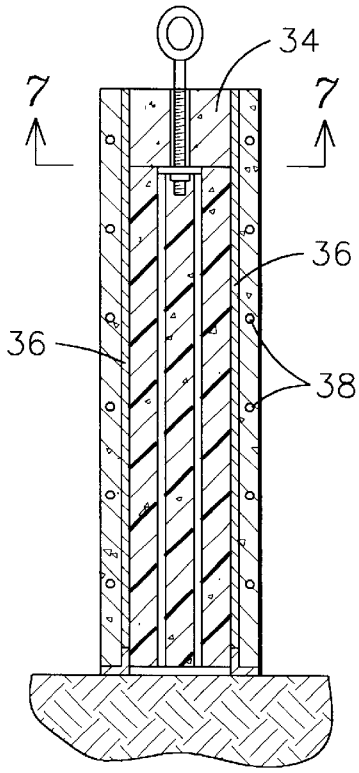
FIG. 4 is a vertical sectional view of the invention taken at 4—4 of FIG. 8.
Figure 7:
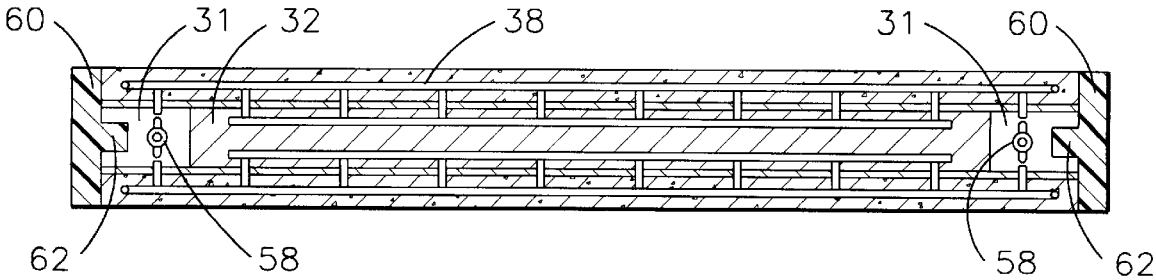
FIG. 7 is a top plan view of an assembled wall unit prior to a final pour of concrete, taken at 7—7 of FIGS. 2 and 4.
Figure 8:
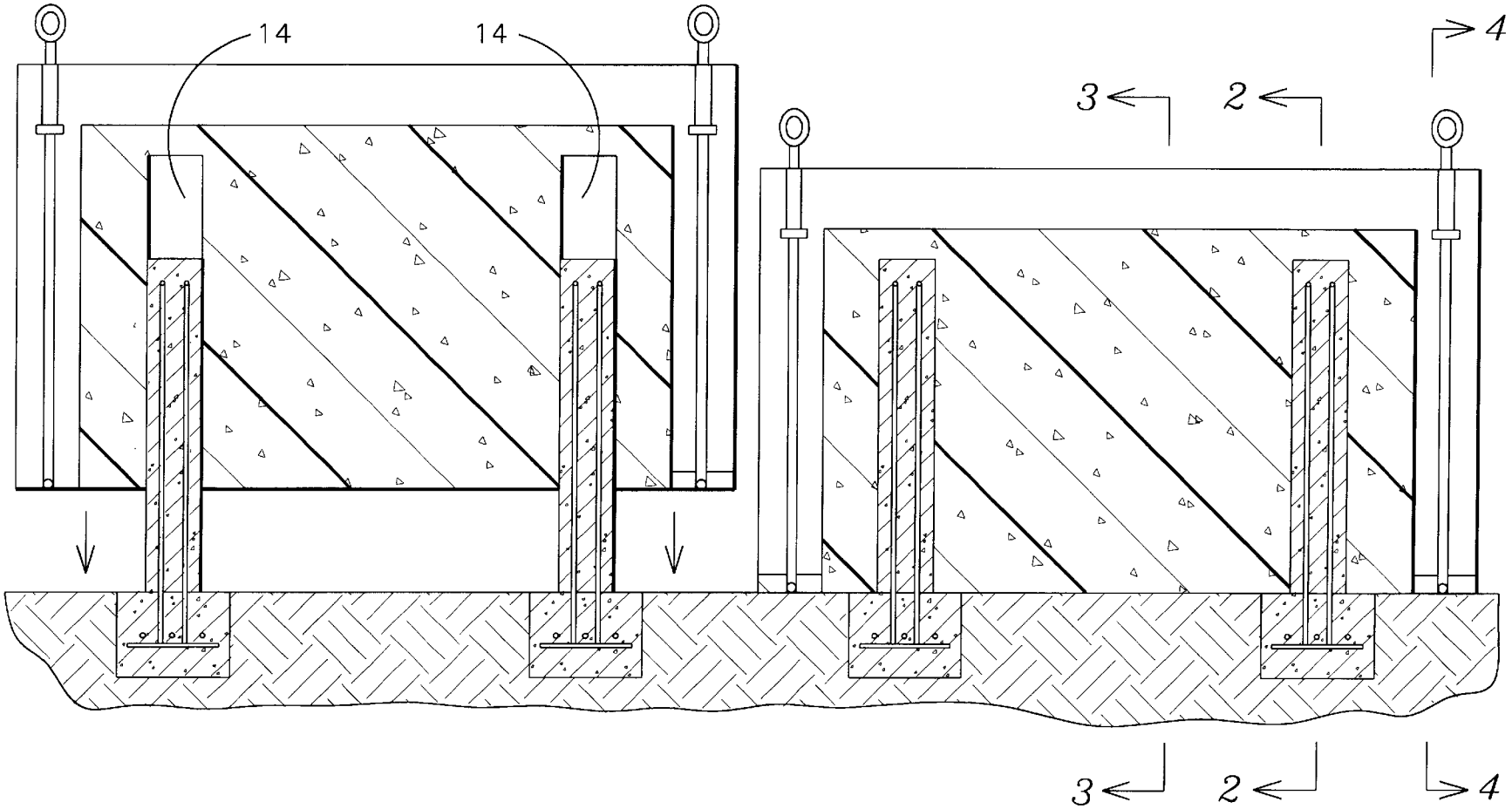
FIG. 8 is a vertical sectional view of two wall units taken at 8—8 of FIG. 2, one of which units is in the process of being lowered onto its supports, with the other unit already in place.
Figure 12:
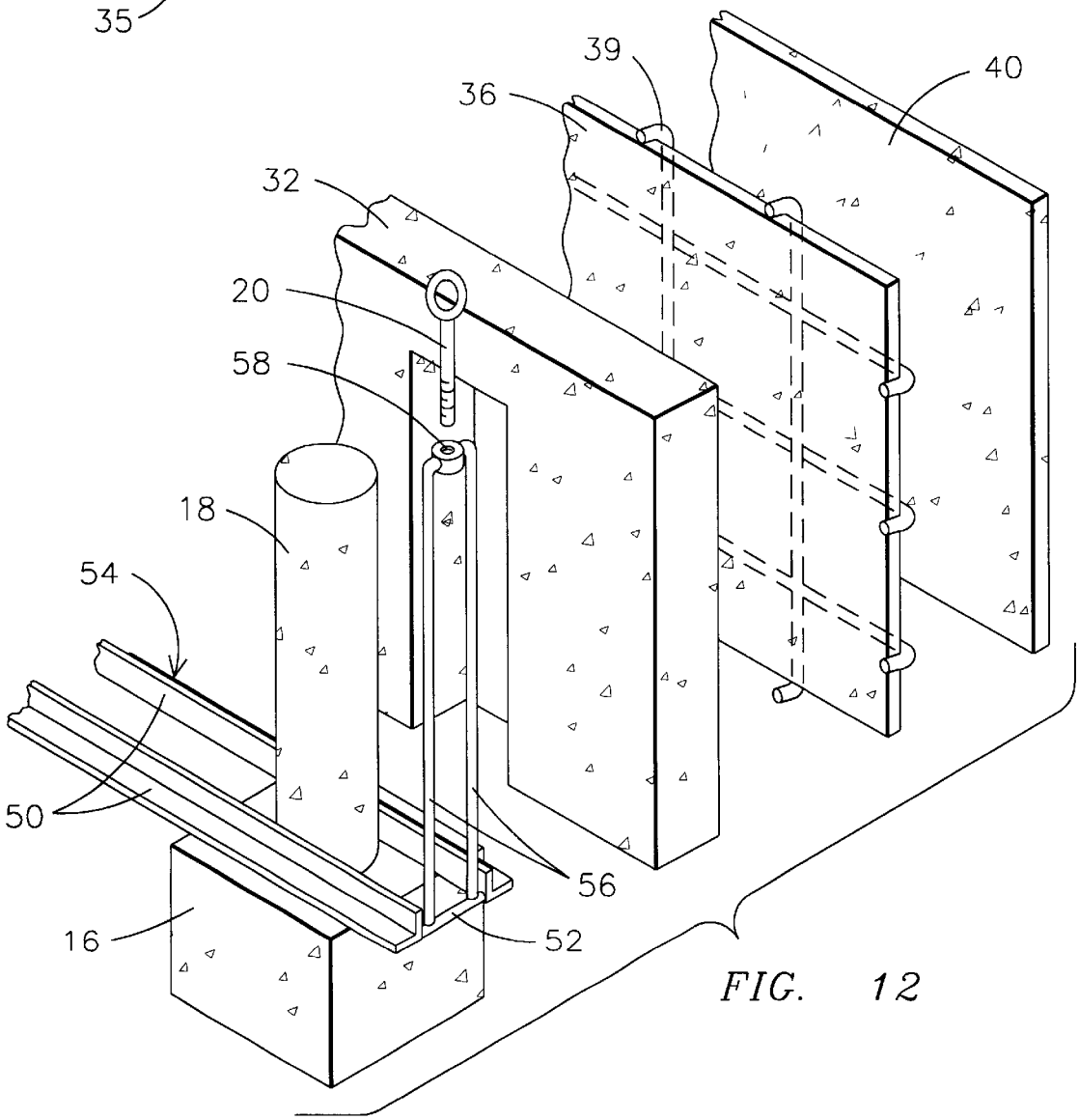
FIG. 12 is an exploded detail view of supporting framework and assembly of a wall unit

Styrofoam® block 32 is smaller in length and height than panels 30, leaving spaces 31 along three edges of the sandwich: the top and two ends of the panel. Spaces 31 are filled with additional concrete and metal framework, as shown in FIGS. 4 and 12. Strips 50 of angle iron extend under the fourth or bottom edge of each panel 30 from one end thereof to the other. At each said end, strips 50 are welded to connecting bars 52, forming a rectangular frame 54 to support the sandwich of panels 30 and Styrofoam® block 32 on edge as a wall unit 12. Vertical rods 56 of reinforcing bar are welded at their lower ends perpendicular to connecting bars 52, and to a nut 58 at their upper ends, nut 58 sized for mating with an eyebolt 20. Rods 56, connecting bars 52, and nut 58 fit within the vertical space 31 at each end of unit 12. The assembly of rods 56, connecting bars 52, eyebolts 20, nuts 58, and frame 54 serve to tie together the sandwich, and comprise a supporting sling and reinforcing structure, when embedded and bonded to panels 30 by a final pour 34 of concrete filling spaces 31 at the top and ends of unit 12. As shown in FIG. 7, forms 60 cover each end of unit 12 to contain the concrete filling spaces 31 at the ends of unit 12, and these forms have protrusions 62 to create the channels 64 shown in FIG. 1. The forms are discarded when the concrete hardens, and the channels 64 formed thereby accept expansion joint fillers 66, as shown in FIG. 5. Expansion joint fillers are commonplace building materials and are usually made of rubber. Alternatively, forms 60 could provide for a male dovetail 68 at one end of wall unit 12, to be formed during the final pour of concrete, and a female groove 70 formed at its other end, for receiving a dovetail from another unit 12, as indicated in FIG. 6.

Figure 11:
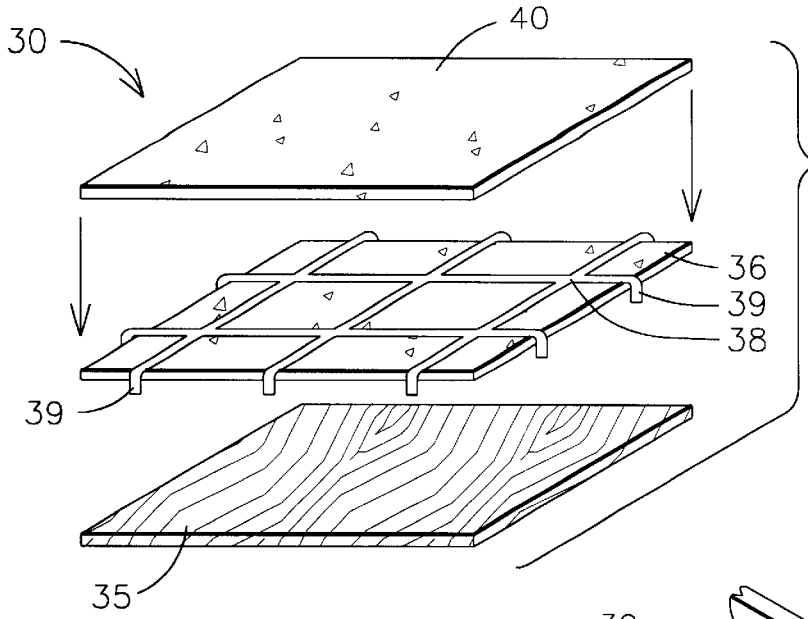
FIG. 11 is an exploded perspective view of the layers comprising one side of a wall unit.

As shown in FIGS. 11 and 12, manufacture of panels 30 can proceed in several ways. Preferably for a wall panel, a thin lining 36 of fiberglass is laid on a flat form 35 of plywood or other suitable material having the dimensions of the desired wall unit. The grid 38 of steel reinforcing bar is then laid out on top of the fiberglass membrane 36, and the concrete 40 is then poured over all. Optimally, a thin layer of concrete containing fiber mesh could be poured onto the fiberglass membrane, which allows the resin of the fiberglass to bond with the mesh. When that hardens the steel grid 38 goes on and the outer layer 40 is poured. Alternatively grid 38 could be laid out on form 35, the concrete 40 poured, and the fiberglass lining 36 could be formed last. The form 35 is discarded after the materials have hardened.

FIGS. 7 and 11 depict the ends of the bars forming grid 38 are bent at right angles, roughly, creating retention hooks 39 to hold Styrofoam) block 32 in place.

Following assembly of the sandwich and final pour of concrete, bores 14 are formed in Styrofoam® block 32 to coincide with the dimensions and positioning of columns 18 and footing members 16. After wall units are lowered into place onto footing members 16, with bores 14 mating with columns 18, one wall unit is joined to another, end to end, with a rubber expansion joint filler 66, as previously described. Alternatively, for units 12 made with dovetails 68 and grooves 70, as in FIG.6, the dovetails and grooves must mate as the units are lowered into place onto columns 18 and footing members 16.

Figure 9:
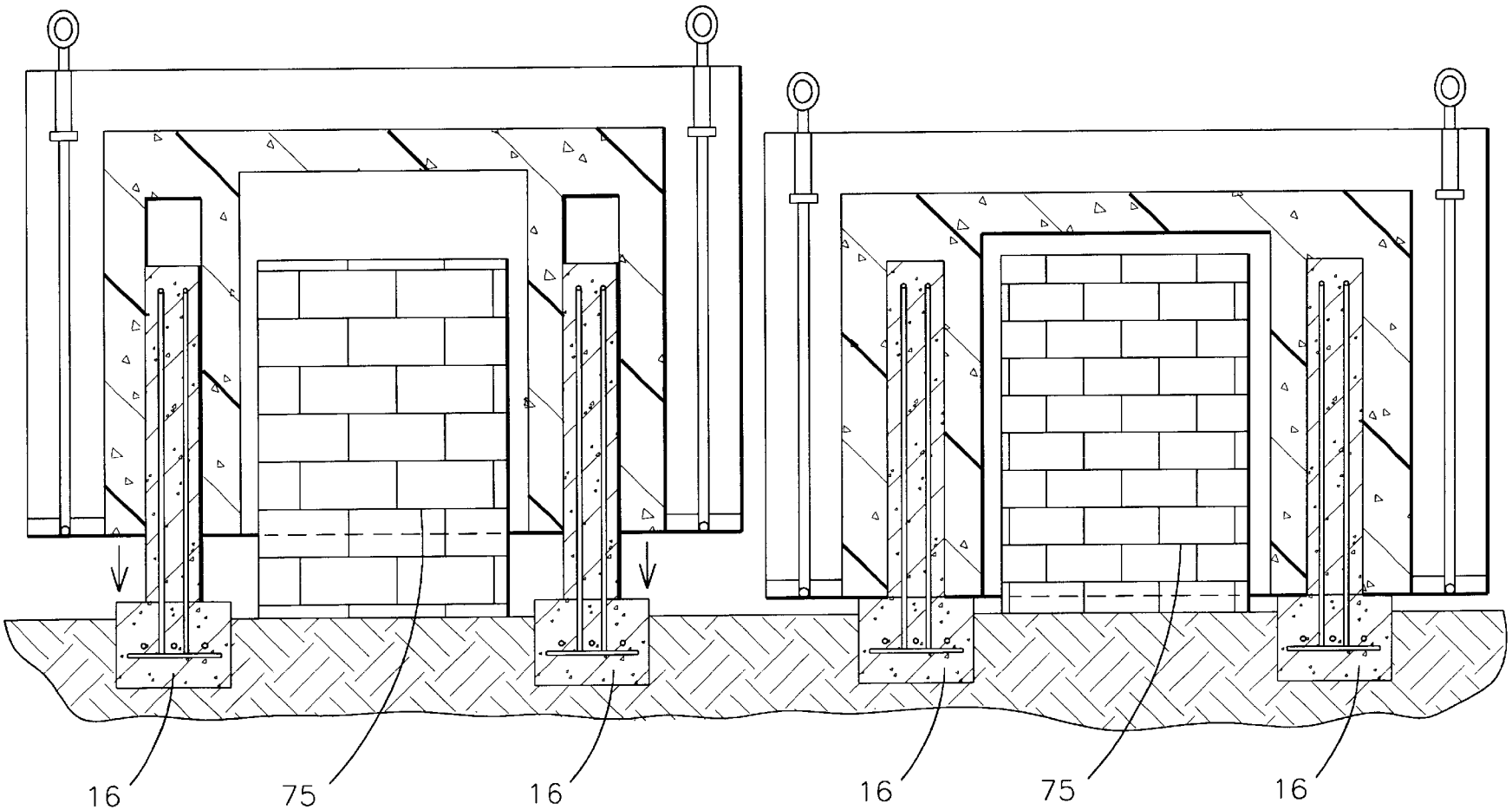
FIG. 9 shows an installation of another embodiment of the invention over a preexisting wall.

FIG. 9 illustrates the use of the present invention to sleeve an existing wall without the need for removing all of the old wall 75. It is necessary to remove only those portions necessary to make room for footing members 16 and columns 18, and the solid ends of wall units 12. Obviously, extensive portions of the Styrofoam® block 32 have to be removed to make room for those portions of the old wall left standing.

Figure 10:
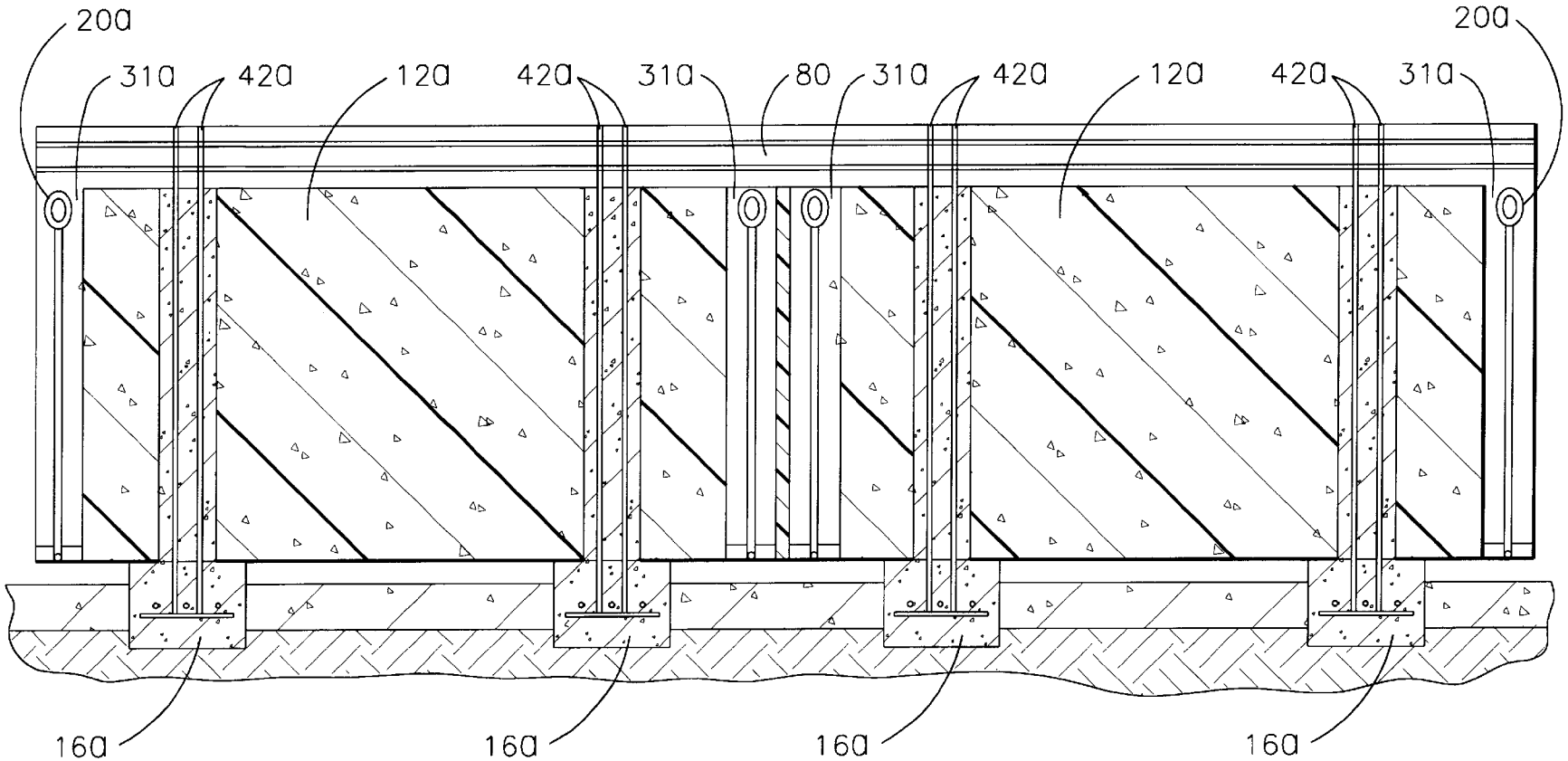
FIG. 10 is a vertical sectional view similar to FIG. 8 of a third embodiment of the invention configured for use as the wall of a building.

Another application of this invention is to use it in construction of a building, particularly where crawl space under the subfloor is desired, as is shown in FIG. 10. In such application, the footing members 16*a* are poured to a height above grade, and are made large enough to support the floor joists as well as the wall units 12*a*. Reinforcing bars 42*a* extend above footing members 16*a* so that they will be incorporated into tie-beam 80, which is poured after wall units 12*a* are lowered into place on footing members 16*a*. Vertical spaces 31*a* are filled with concrete before placement on footing member 16*a*, and small amounts of removable material such as paper or foam keep the eyebolts 20*a* and nuts 58 free of concrete to enable lifting of the panels 12*a*.

This invention can be used for any type of barrier, privacy or retaining walls, for subdivisions and along roadways. The wall units 12, being removable, can be temporarily lifted off the footing members 16 to provide access for large equipment and then replaced, or reused if the wall system needs to be moved when a roadway is widened, for instance. Because the system has two grids of reinforcing steel bar running its entire length it provides greater tensile strength compared to a traditional masonry wall of brick, stone, or block. It is believed that the system will comply with the latest building codes which require masonry walls to withstand one hundred mile-an-hour winds. When struck by an out-of-control vehicle, a wall unit might break but should not crumple or scatter and should bring the vehicle to a halt. The Styrofoam® foam core in the wall units can be easily drilled out in varying degree and configuration, making the system adaptable as a sleeve over a variety of old walls. The Styrofoam® foam core additionally makes the units much lighter in weight than solid concrete panels commonly in use.

There are various changes and modifications which may be made to the invention that would be apparent to those skilled in the art. However, these changes or modifications are included in the teaching of the disclosure, and it is intended. that the invention be limited only by the scope of the claims.

What is claimed is:

1. A prefabricated modular wall system comprising:

a plurality of wall sections substantially rectilinear in shape, each section having an expanded closed-cell foam core having opposing vertical faces, having top and bottom edges, having vertical ends, each said vertical face being sheathed with a wafer comprised of an inner layer of plastic resin and an outer layer of reinforce concrete, said wafer extending beyond said vertical ends of said foam core, forming a vertical recess at each end of each said wall section, each said recess filled with reinforced concrete and having a vertical groove in said reinforced concrete for accepting means of connecting a wall section to another wall section, said foam core having at least two vertical voids opening at said bottom ed of said core;

a plurality of reinforced support column members, each column member integral with a concrete footer in the ground, said column members aligned and spaced in a single line, so as to mate with said vertical voids in said wall sections whereby, said wall section form a continuous wall of any predetermined length;

a plurality of removable connecting means inserted in each said vertical grove whereby each said wall section is joined at one or both vertical ends thereof to another said wall section.

2. The system as in claim 1 wherein said wafers extend above said top edge of said foam core forming a top recess, said recess being filled with a cap of concrete.

3. The system as in claim 2 further comprising means embedded at each end of said cap of concrete for attaching hoisting apparatus for lifting said wall sections vertically and lowering them onto said support column members.

4. The system as in claim 3 wherein said exterior layers of reinforced concrete of said wafers and said vertical recesses contain steel rebar.

5. The system as in claim 4 wherein each said wafer of reinforcing material has an angle iron extending the length of its bottom edge, each end of said angle iron being welded to said rebar in said vertical recesses, and said cap of concrete has eyebolt and nut members at each end thereof, said nuts welded to said rebar in said vertical recesses, thereby providing a supporting sling structure for hoisting said wall sections.

6. The system as in claim 5 wherein said connecting means comprises an expansion joint filler.

7. The system as in claim 5 wherein said connecting means comprises a tongue member at one end of each said wall section and a groove member at the opposite end thereof, whereby a tongue member of one said wall section mates with a groove member of an adjacent wall section.

8. A prefabricated modular wall system comprising:

a plurality of wall section substantially rectilinear in shape, each section having an expanded closed-cell foam core having opposing vertical faces, having top and bottom edges, having vertical ends, each said vertical face being sheathed with a wafer comprised of an inner layer of plastic resin and an outer layer of reinforced concrete, said wafer extending beyond said vertical ends and top edge of said foam core, forming a vertical recess at each end of each said wall section and a top recess, the top edge being filled with a cap of concrete, each said vertical recess filled with reinforced concrete including rebar, having a vertical groove therein for accepting means of connecting one said wall section to one or more other said wall sections, said foam core having at least two spaced-apart vertical voids opening at said bottom edge of said core;

each said wall section supported by a pair of angle irons co-extensive with its bottom edges and welded to said rebar in said side recesses, said rebar in said vertical recesses welded at their top ends to nuts for receiving removable eyebolts, whereby each said wall section is held in a supporting sling structure that can be attached to cables and hoisting apparatus for hoisting and lowering said wall sections;

a plurality of reinforced support column members, each column member integral with a concrete footer in the ground, said column members aligned and spaced in a single line, so as to mate with said vertical voids in said wall suctions whereby said wall section form a continuous wall of any predetermined length;

a plurality of removable connecting means inserted in each said vertical groove whereby each said wall section is removably joined at one or both vertical ends thereof to another said wall section.

* * * * *